United States Patent [19]

Ilukowicz

[11] 4,007,572

[45] Feb. 15, 1977

[54] HOG SLAT REINFORCING BAR SUPPORT

[75] Inventor: Robert J. Ilukowicz, Coram, N.Y.

[73] Assignee: Preco Industries, Ltd., Plainview, N.Y.

[22] Filed: Oct. 24, 1975

[21] Appl. No.: 625,635

[52] U.S. Cl. ..... 52/687

[51] Int. Cl.[2] ..... E04C 5/16; E04G 17/06

[58] Field of Search ..... 52/677–689; 249/40; 119/20, 27, 28

[56] References Cited

UNITED STATES PATENTS

| | | | |
|---|---|---|---|
| 1,268,887 | 6/1918 | Schroeder | 52/687 |
| 1,880,710 | 10/1932 | Bitney | 52/687 |
| 3,530,634 | 9/1970 | Adams | 52/687 |
| 3,694,989 | 10/1972 | Oliver et al. | 52/687 |

FOREIGN PATENTS OR APPLICATIONS

| | | | |
|---|---|---|---|
| 904,766 | 8/1962 | United Kingdom | 52/687 |

*Primary Examiner*—J. Karl Bell
*Attorney, Agent, or Firm*—Roberts & Cohen

[57] ABSTRACT

A hog slat reinforcing bar support comprising a one-piece plastic body with first and second support portions for respective reinforcing bars. Each portion includes a surrounding wall with an opening through which the associated reinforcing bar can be inserted and held within the support portion. The portions are connected by a connection piece and projecting members extend laterally from the body and define a plurality of support points by which the body can be stably supported in a trapezoidal hog slat form and the reinforcing bars held in predetermined positions therewithin.

4 Claims, 3 Drawing Figures

HOG SLAT REINFORCING BAR SUPPORT

FIELD OF THE INVENTION

The invention relates to hog slat reinforcing bar supports and the like adapted for supporting reinforcing bars within a hog slat form or the like.

BACKGROUND OF THE INVENTION

In the conventional type of concrete hog slats (i.e., slender forms of trapezoidal cross-section), reinforcing bars may be provided at the top and bottom. The bottom reinforcing bar is initially supported within the casting form for the slat by suitable means so as to hold the bar in position and the top bar is hand placed after pouring of the concrete into the form. Centering of the bars is accomplished by eye and usually is inaccurate by virtue of the lack of lateral restraint. Additionally, it is very difficult to place the top bar accurately at a given position in the concrete.

SUMMARY OF THE INVENTION

An object of the invention is to provide a support member for reinforcing bars in a hog slat form, which will maintain such bars in given position so that they are accurately placed in the resulting concrete hog slat.

Another object of the invention is to provide a support member of the above type which includes projecting members which engage the form to provide lateral restraint for the support member, thereby stably supporting the reinforcing members within the form.

In accordance with the above and further objects, the invention contemplates a hog slat reinforcing bar support comprising a one-piece plastic body including first and second support portions for respective reinforcing bars, each portion including a surrounding wall with an opening through which the associated reinforcing bar can be inserted, means connecting said portions, and projecting members defining a plurality of support points by which the body can be stably supported in a form and the reinforcing bars held in pre-determined positions within said whereby the reinforcing bars will be placed within the cast body at pre-determined position therein.

In further accordance with the invention, said support portions are aligned and said connection means comprises a straight connecting piece joining said support portions.

Said projecting members preferably include two pairs of arms extending laterally with respect to said straight connecting piece for engaging the side walls of the form to provide lateral restraint.

One of the projecting members projects from the bottom of the body in alignment with the connecting piece for support of the body on the bottom of the form.

In further accordance with the invention, the opening in each wall is smaller in size than the corresponding support portion whereby the reinforcing bars are forcibly inserted into the respective support portion and tightly maintained therein.

The invention will be described in greater detail hereafter with reference to the annexed drawing.

DETAILED DESCRIPTION

Figure 1:
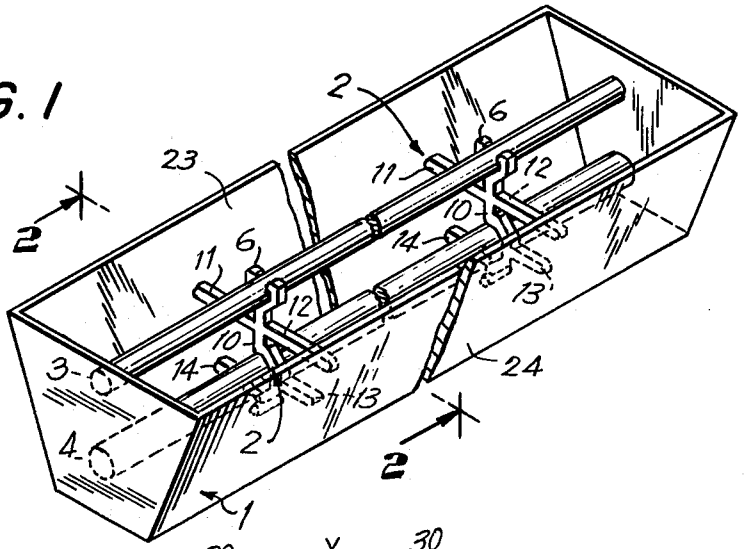
FIG. 1 is a perspective view, partly broken in length, showing a hog slat form with two supports and reinforcing bars mounted therein.

Referring to FIG. 1 of the drawing, therein is seen a form 1 of wood or other suitable material assembled in trapezoidal cross-section for receiving concrete to produce a hog slat which is a reinforced concrete beam of trapezoidal cross-section. Hog slats are well known in the art. In use, hog slats are placed closely together in side by side relation with their wide ends facing upwardly to form a "slotted floor" for cattle, hogs, and sheep. The hog slats are uniformly spaced and the openings between the slats permit the animal wastes to be worked by the feet of the animal through the floor into a gutter or pit therebelow for later processing into fertilizer. As a consequence, the animals remain relatively dry and clean. Such slats of reinforced concrete are durable and can be cast in a wide variety of sizes depending on the use of the floor for particular animals.

In order to support the weight of the animals, it is necessary to provide reinforcing bars at the top and bottom of the hog slats and in general, a number 4 (½ inch) steel bar is provided ¾ inch from the bottom and a number 3 (⅜ inch) steel reinforcing bar is provided ¾ inch from the top. The reinforcing bars may be centered along the vertical axis of symmetry of the hog slat.

Heretofore it was conventional to mount the lower reinforcing bar in the form by means of suitable clips or the like, and after the concrete was poured, the top bar was hand-placed in the concrete. Centering was effected by eye and was usually inaccurate as there was not lateral restraint. Furthermore, it was very difficult to place the top reinforcing bar accurately at a depth of ¾ inch in the concrete.

The invention contemplates the placement of at least two support members 2 within the form 1 so as to support and maintain reinforcing bars 3 and 4 therewithin at pre-determined locations. Namely, the support members 2 position the reinforcing bars 3 and 4 in the center plane of the form and at specific distances from the top and bottom thereof. The support of the reinforcing bars 3 and 4 by members 2 is such that their position will be undisturbed in the course of pouring of concrete, whereby the reinforcing bars will occupy precise positions in the cast slat.

Figure 2:
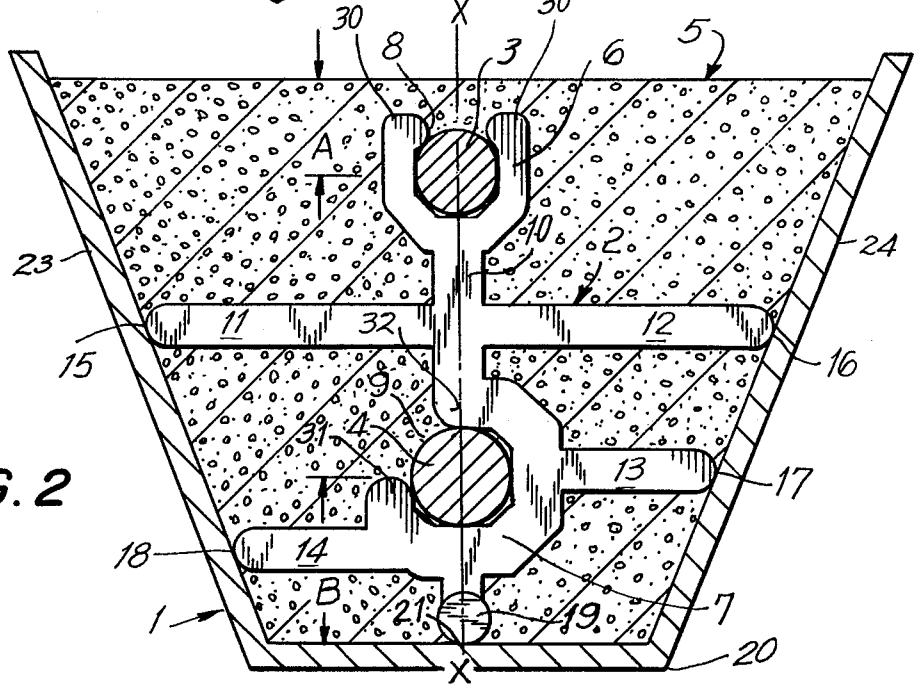
FIG. 2 is a transverse sectional view taken on line 2—2 in FIG. 1 showing one embodiment of a support.

Referring more specifically to FIG. 2, therein it can be seen that the reinforcing bars 3 and 4 are placed in exact vertical alignment along the vertical axis of symmetry of the form 1. Moreover, the center of bars 3 and 4 are respectively positioned at distances A and B from the top and bottom of the cast slat 5.

By virtue of the perfectly centered position of the bars 3 and 4, an accurate position of the reinforcing bars will be obtained in the slat and this produces a high quality slat which is of constant strength and is reliable in use for the formation of the slotted floor while being perfectly capable of reliably bearing the weight of the animals thereon.

Referring now to the support member 2 in greater detail, it is seen that this member is made from a one-piece body of plastic material such as PVC, nylon, polyethylene, etc. The body includes first and second support portions 6 and 7 for the reinforcing bars 3 and 4 respectively. Each portion is composed of a surrounding wall which has an opening through which the associated reinforcing bar can be inserted. As seen in FIG. 2, portion 6 has an opening 8 while portion 7 has an opening 9. Portions 6 and 7 are connected by a straight connecting piece 10 which joins the portions 6 and 7 in vertically aligned relation so that the reinforcing bars will be disposed exactly one above the other.

The body furthermore includes a first upper pair of laterally projecting arms 11 and 12 and a second pair of laterally projecting arms 13 and 14. The arms 11 and 12 are located at the same level and extend laterally so as to engage the inclined side walls 23 and 24 of form 1 at points 15, 16. The arm 13 of the second pair contacts lateral wall 24 at point 17 and the arm 14 contacts lateral wall 23 at point 18. The ends of the lateral arms are all rounded so as to define clearly the contact thereof with the side walls of the form. As a consequence of the four points of support of the arms on the support member with the inclined side walls of the form, the support 2 will be stably supported and laterally restrained.

At the bottom of the support member there is a further projecting arm 19, which contacts the bottom wall 20 of the form at 21. The arm 19 is of cylindrical shape so as to provide a definite line of contact at 21. As can be seen, the arm 19 is aligned with the connecting piece 10, and these are disposed along the vertical axis of symmetry X—X of the form 1. Thereby reinforcing members 3 and 4 will be precisely positioned on axis X—X.

The operation of installing the reinforcing bars within the form is as follows:

Each reinforcing bar is inserted through the associated opening into the corresponding support portion of at least two supports 2. The size of the opening in each support is such that the reinforcing bar is forcibly inserted into its supporting portion. The free ends 30 of the supporting portion 6 are so positioned to forcibly hold the reinforcing bar 3 within the supporting portion.

The supporting portion 7 has a free end 31 facing the opposed portion 32 bounding opening 9 so that when bar 4 is inserted in portion 7 it will be elastically retained therein.

The assembly of bars and supports is then inserted into the corresponding hog slat form, and the ends of the laterally projecting arms contact the side walls of the form. It is also possible to first position the supports 2 in the form and then insert the reinforcing bars 4 and 3 into the same. In either case, the reinforcing bars will be exactly positioned and stably held in position within the cast concrete hog slat.

In order to insure the tight engagement of the free ends 30 of the support portion 6 with the reinforcing bar 3, the arms 11 and 12 are connected to the connecting piece 10 thereby leaving the ends 30 free to elastically deform.

The arm 13 laterally projects from the center of support portion 7, while the arm 14 projects on the opposite side, at a lower level, from the bottom of support portion 7. Thereby, the end 31 is free to deflect and reinforcing bar 4 can be forced into support portion 7 and supported therein without any interference by the arms 13 and 14. Moreover, the slightly upwardly facing disposition of opening 9 and the opposed relation of arm 13 at the center of support portion 7 insures that the reinforcing bar 4 can be forcibly inserted into the support portion 7 without upsetting the position of the support 2.

Figure 3:
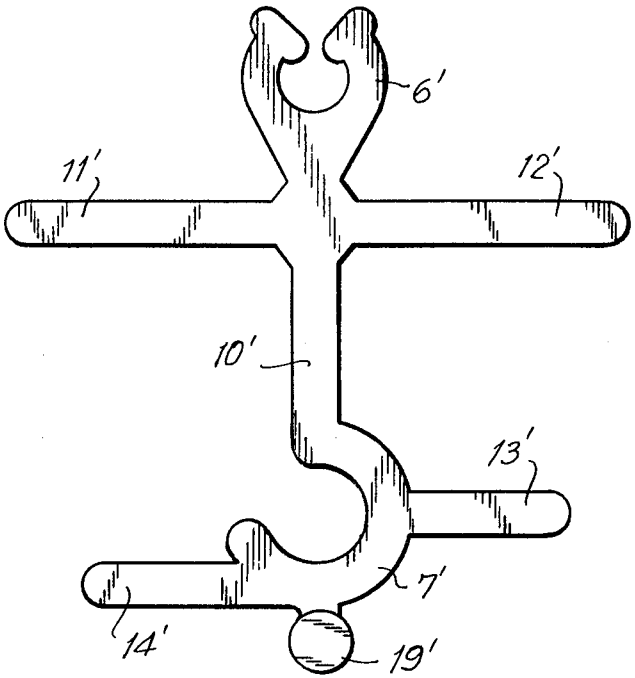
FIG. 3 is a front elevation view of a second embodiment of a support.

FIG. 3 shows a modified embodiment and herein the same numerals with primes are employed for elements corresponding to those in the embodiment of FIG. 2. In this embodiment, the support is intended to be used with a deeper hog slat and for this purpose connecting piece 10′ is of greater length than connecting piece 10 in the previously described embodiment. Additionally, as seen, the support portions 6′ and 7′ define circular support surfaces rather than the polygonal surfaces as in the embodiment in FIG. 2. In view of the greater length of connecting piece 10′, the arm members 11′ and 12′ are positioned at the juncture of support portion 6′ and connecting piece 10′, so as to form a rigid connection thereat.

The sizes of the hog slats can vary and some typical sizes are given hereafter, the first number representing the length of the narrow side of the hog slat, the second dimension the length of the wide side of the hog slat and the third dimension the height of the hog slat:

3″: 5″: 4″; 3″: 5″: 5″; and 5″: 5″: 7″.

The slats can be approximately 6–10 feet long. As previously noted, the reinforcing bar 3 is generally of ⅜ inch diameter and the reinforcing bar 4 of ½ inch diameter.

Although the invention has been described in relation to two specific embodiments thereof, it is clear that numerous modifications and variations will become evident to those skilled in the art without departing from the scope and spirit of the invention as defined by the attached claims.

What is claimed is:

1. A hog slat reinforcing bar support comprising a one-piece plastic body including first and second support portions for respective reinforcing bars, each portion including a surrounding wall with an opening through which a reinforcing bar can be inserted, means connecting said portions, and projecting members defining a plurality of support points by which said body can be stably supported in a form and the reinforcing bars held in predetermined positions within said form whereby upon the casting of concrete within said form the reinforcing bars will be placed within the cast body at pre-determined positions therein, said support portions being aligned and said connection means comprising a straight connecting piece joining said support portions; said projecting members including two pairs of arms extending laterally with respect to said straight connecting piece and a projection at the bottom of said body in alignment with said connecting piece, one of said pairs of arms being disposed above the other pair and having a greater length than said other pair, said arms of said other pair being disposed at different levels.

2. A support as claimed in claim 1 wherein said projection is cylindrical.

3. A support as claimed in claim 1 wherein one of the arms of said other pair extends centrally from the associated support portion and the other of the arms extends from the bottom of the said associated support portion.

4. A support as claimed in claim 3 wherein said arms of said one pair extend at a common level from said straight connecting piece.

* * * * *